US005722118A

United States Patent [19]

Hansen et al.

[11] Patent Number: 5,722,118

[45] Date of Patent: Mar. 3, 1998

[54] HANDLE CONVERSION APPARATUS

[75] Inventors: Barbara Hansen, Chicago; Lin Beribak, Forest Park; Marcie Moran, Naperville; Krista Brown, Chicago, all of Ill.

[73] Assignee: Jetset Design, Chicago, Ill.

[21] Appl. No.: 672,419

[22] Filed: Jun. 28, 1996

[51] Int. Cl.[6] ..... A47B 95/02

[52] U.S. Cl. ..... 16/114 R; 294/137

[58] Field of Search ..... 16/DIG. 15, 114 R, 16/124; 294/171, 153, 154, 157, 137

[56] References Cited

U.S. PATENT DOCUMENTS

| | | | |
|---|---|---|---|
| D. 256,405 | 8/1980 | Wheeler | D3/30 |
| D. 259,238 | 5/1981 | Schenck, III | D8/307 |
| D. 303,076 | 8/1989 | Castelli et al. | D8/306 |
| D. 316,804 | 5/1991 | Foulke et al. | D8/307 |
| D. 360,570 | 7/1995 | Lien et al. | D8/307 |
| 707,669 | 8/1902 | Young . | |
| 2,339,646 | 1/1944 | Mann . | |
| 3,257,120 | 6/1966 | Browning . | |
| 3,306,507 | 2/1967 | Wilson . | |
| 3,578,226 | 5/1971 | Good | 224/45 |
| 3,948,365 | 4/1976 | Gregg et al. | 190/18 A |
| 3,982,613 | 9/1976 | Wood | 190/58 B |
| 4,004,722 | 1/1977 | Olivier | 224/45 P |
| 4,245,763 | 1/1981 | Weinberg | 224/45 P |
| 4,256,320 | 3/1981 | Hager | 280/37 |
| 4,538,709 | 9/1985 | Williams et al. | 190/18 A |
| 4,596,397 | 6/1986 | Conti | 280/47.13 R |
| 4,679,670 | 7/1987 | Wickman | 190/18 A |
| 4,708,357 | 11/1987 | Soderbaum | 280/289 H |
| 4,791,702 | 12/1988 | McVey | 16/114 B |
| 4,852,705 | 8/1989 | Cowan, Jr. | 190/18 A |
| 4,887,825 | 12/1989 | Allen et al. | 16/115 |
| 4,890,355 | 1/1990 | Schulten | 16/111 R |
| 5,048,649 | 9/1991 | Carpenter et al. | 190/18 A |
| 5,249,438 | 10/1993 | Rhaney et al. | 62/457.7 |
| 5,265,307 | 11/1993 | Hull et al. | 16/114 R |
| 5,319,829 | 6/1994 | Manuel | 16/114 R |
| 5,339,934 | 8/1994 | Liang | 190/18 A |
| 5,351,793 | 10/1994 | Gibbs | 190/115 |
| 5,474,162 | 12/1995 | Shyr et al. | 190/18 A |

FOREIGN PATENT DOCUMENTS

| | | | |
|---|---|---|---|
| 2051940 | 3/1993 | Canada | 16/114 R |

*Primary Examiner*—Chuck Mah
*Assistant Examiner*—Mark Williams
*Attorney, Agent, or Firm*—Dick & Harris

[57] ABSTRACT

A handle conversion apparatus for attachment to a preexisting handle of a wheeled object, such as a wheeled suitcase. The preexisting handle of the wheeled object has a grip member positioned for use in a position substantially perpendicular to a desired direction of forward and backward motion of the wheeled object. The handle conversion apparatus comprises an apparatus attachment member for attaching the apparatus to the preexisting handle of the wheeled object, towards conversion of its orientation by 90 degrees. The apparatus further includes a hand grip having a first end, a second end opposite the first end, and a longitudinal axis between the first and second ends; the longitudinal axis being substantially perpendicular to the grip member of the preexisting handle. An orientation member is positioned between the attachment member and the hand grip to prompt the hand grip longitudinal axis into an orientation substantially parallel to the direction of forward and rearward motion of the wheeled object, and to operably integrate each to the other.

19 Claims, 1 Drawing Sheet

20
100
11
10
12
13

130
103
140
102
145
135
113
132
101
111
141
131

103
135
102
145
111
112
101
110

230
132
240
102
245
103
232
101
200
231

102'
145'b
145'a
101'

146
145"b
145"a 118
102
114
145
11
116
20
117
115

102
120
145
114
116
115
119

HANDLE CONVERSION APPARATUS

BACKGROUND OF THE INVENTION

1. Field of the Invention

The present invention relates in general to handles for wheeled objects, such as a wheeled suitcase or cart, and, in particular, to a handle conversion apparatus for reorienting the position of the handle used to direct the wheeled object for forward and rearward motion; to minimize the arm and/or wrist strain of a user pulling the wheeled object.

2. Background Art

Much of the commercially available wheeled luggage and hand carts have an integral, rigid or retractable, structured handle which provides the user a gripping surface in a position typically perpendicular to the direction the user is pulling the luggage or cart. For instance, Shyr et al., U.S. Pat. No. 5,474,162; PCT Application No. WO93/18684; Browning, U.S. Pat. No. 3,257,120; Cowan, U.S. Pat. No. 4,852,705; Carpenter et al., U.S. Pat. No. 5,048,649 and Liang, U.S. Pat. No. 5,339,934 each disclose this type of wheeled object. Another type of commercially available wheeled luggage is shown in Gibbs, U.S. Pat. No. 5,351,793, which utilizes an unstructured, often flexible strap to pull the wheeled object.

The guiding of wheeled luggage having such integral, rigid or retractable, structured handles often cause undesirable discomfort in the arm or wrist of frequent users of such products, such as airline employees, sales people, court reporters and the like; as a result of the unnatural positioning of the arm and wrist necessitated by the positioning of the preexisting handle of the wheeled object. In particular, the grip member of the preexisting handle is typically positioned for use in a position substantially perpendicular to the desired direction of forward and backward motion of the wheeled object. This positioning causes an awkward under (or over) grip of the grip member, in turn, forcing the user's elbow, armor wrist to be uncomfortably extended or twisted, under force for extended periods of time.

There are a number of references that disclose wheeled suitcases with direction-parallel handles, including Wood, U.S. Pat. No. 3,982,613; Gregg et al., U.S. Pat. No. 3,948,365; Hager, U.S. Pat. No. 4,256,320; Williams et al., U.S. Pat. No. 4,538,709; Wickman, U.S. Pat. No. 4,679,670; and Rhaney et al., U.S. Pat. No. 5,249,438. In each of these disclosures, however, these handles are integrated to their respective wheeled cases.

It is thus an object of the present invention to provide a handle conversion apparatus for attachment to a preexisting handle that provides the user with a gripping surface that is parallel to the desired direction of forward and rearward motion of the wheeled object.

It is further an object of the present invention to provide a handle conversion device capable of reorienting the useable handle grip of a vast variety of wheeled articles, to provide comfort to the user—while being easily attachable and detachable from an existing, offset handle, through a device that is relatively easy and inexpensive to manufacture, while retaining the original wheeled article.

These and other objects of the present invention will become apparent in light of the present specification, claims and drawings.

SUMMARY OF THE INVENTION

The present invention comprises a handle conversion apparatus for attachment to a preexisting handle of a wheeled object, such as a wheeled suitcase or hand cart, toward reorienting the position and angle at which a user may more comfortably grasp the handle, yet control the movement of the wheeled object. The wheeled object's preexisting handle has a grip member positioned for use in a position substantially perpendicular to a desired direction of forward and rearward motion of the wheeled object.

In particular, the handle conversion apparatus comprises an apparatus attachment member, hand grip and orientation member. The apparatus attachment member attaches the handle conversion apparatus to the preexisting handle. The hand grip has a first end, a second end opposite the first end and a longitudinal axis between the first and second ends, which axis is "substantially perpendicular" (though perhaps skewed) to the grip member of the preexisting handle. In the context of the present application, given that the desired benefit of applicant's invention resides in providing a more comfortable positioning for the user's grip and control of the wheeled object, "substantially perpendicular" would be deemed to embrace an angle 5 to 175 degrees from the vertical planes of the grip member of the preexisting handle and the present invention's hand grip. Preferably, an orientation member prompts the longitudinal axis of the hand grip into an orientation substantially parallel to the direction of forward and rearward motion of the wheeled object, with the orientation means being operably attached between the apparatus attachment member and the hand grip so as to integrate same.

In a preferred embodiment, the apparatus attachment member comprises a substantially J-shaped hook having an open top and a cradle bottom. The substantially J-shaped hook's open top allows for receipt of the preexisting handle, while the cradle bottom operably, though releasably, restrains the preexisting handle. In one preferred embodiment, the orientation member connects to both the first and second ends of the hand grip via first and second transition members. It is also contemplated, however, that the orientation member could be connected to only one or the other end of the hand grip. In another preferred embodiment, the hand grip is covered by foam padding. In yet other embodiments, the hand grip includes a plurality of finger receiving indentations along at least the bottom of the hand grip.

While any suitable fastening means may be utilized, in other preferred embodiments of the invention, the apparatus attachment member includes a connecting member and at least one strap, which is configured to operably restrain the preexisting handle, instead of an open top and cradle configuration. In such embodiments, each such strap may include either a snap or hook and loop attachment member.

DETAILED DESCRIPTION OF THE DRAWINGS

Figures 1, 2, 3, 4, 5, 6, 7, 8:
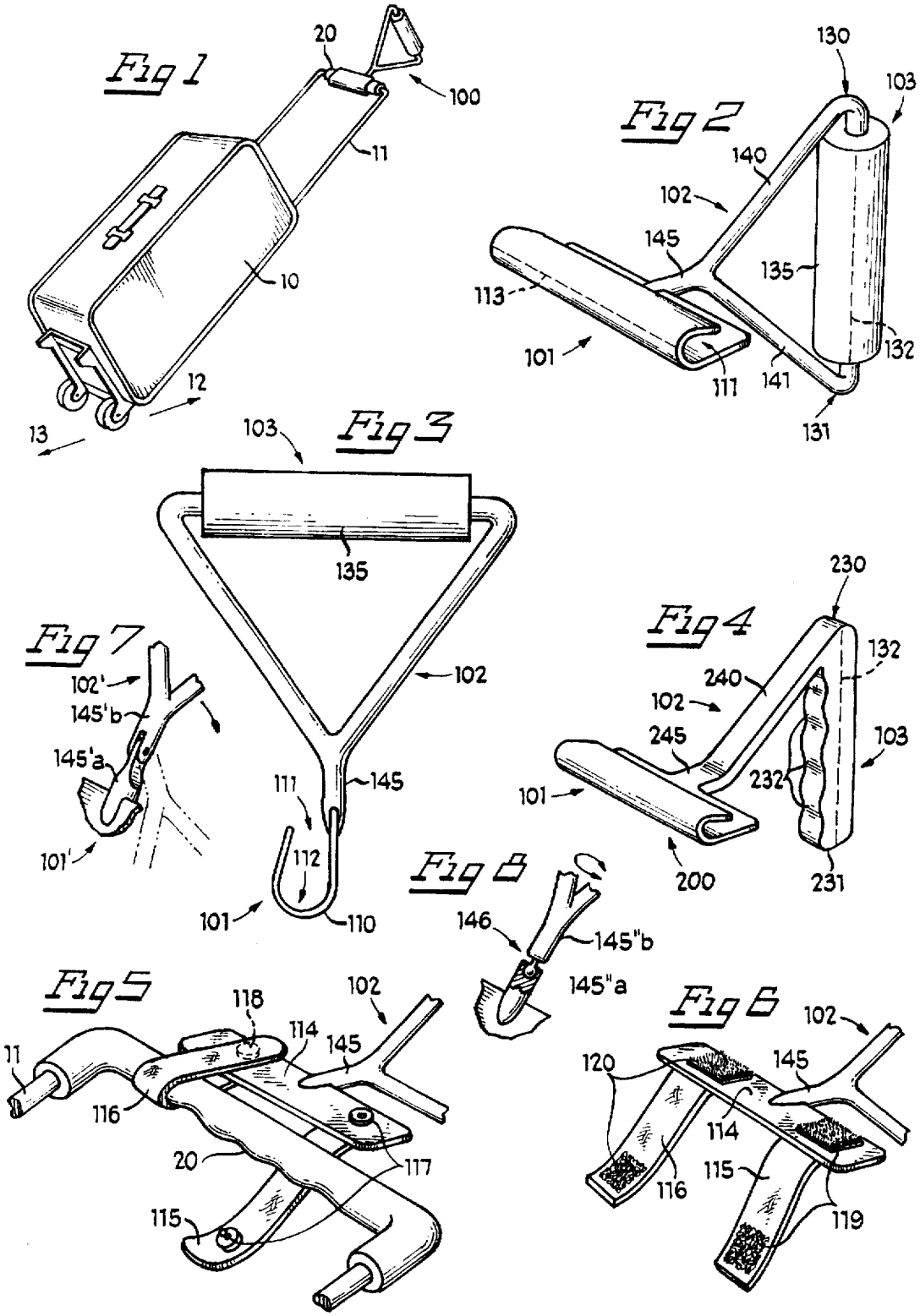
FIG. 1 of the drawings is a perspective view of a wheeled object having the present handle conversion apparatus attached to its preexisting handle.
FIG. 2 of the drawings is a perspective view of one preferred embodiment of the present handle conversion apparatus.
FIG. 3 of the drawings is an elevated side view of the embodiment of the present handle conversion apparatus shown in FIG. 2.
FIG. 4 of the drawings is a perspective view of another embodiment of the present handle conversion apparatus, in which the orientation means emanate from only one end of the hand grip.
FIG. 5 of the drawings is a perspective view of another embodiment of the present handle conversion apparatus, in which straps are utilized to restrain the preexisting grip member.
FIG. 6 of the drawings is a perspective view of another strap embodiment of the present handle conversion apparatus.
FIG. 7 of the drawings is a perspective view of another embodiment of the present handle conversion apparatus, in which the neck swivels in two regions to facilitate storage of the apparatus when not in use.
FIG. 8 of the drawings is a perspective view of another embodiment of the present handle conversion apparatus, in which the neck swivels about a universal joint to facilitate storage of the apparatus when not in use, while permitting variations in the orientation of the hand grip relative to the pre-existing handle.

While this invention is susceptible embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

FIG. 1 of the drawings shows a perspective view of wheeled suitcase 10 having preexisting handle 11 with substantially horizontal grip member 20. In some cases, this preexisting handle 11 may extend from a retracted position in its wheeled suitcase 10 when in use. As known, a user will typically direct wheeled suitcase 10 in either forward direction 12 or rearward direction 13 by manually grasping grip member 20 of preexisting handle 11. However, inasmuch as grip member 20 is positioned for use in a position substantially perpendicular to both forward and rearward travel, users are forced to contort their arm, and particularly their elbows and wrists, to hold grip member 20 while propelling wheeled suitcase 10. This contorted arm positioning is not only uncomfortable, but it can also lead to various injuries—such as shoulder, wrist and elbow strain—particularly in frequent travelers, flight crews, salespeople and others who often use various types of wheeled objects such as suitcases, handcarts and the like.

As shown in FIG. 1, handle conversion apparatus 100 is attached to preexisting handle 11 of wheeled suitcase 10 to provide a hand grip which is reoriented to a position that the user can more easily grasp, to propel any such wheeled object while substantially minimizing the uncomfortable positioning of the user's arm.

As shown with more particularity in FIGS. 2 and 3, handle conversion apparatus 100 is comprised of apparatus attachment means 101, orientation means 102 and hand grip 103. In the preferred embodiment shown in FIGS. 2 and 3, apparatus attachment means 101 comprises a substantially J-shaped hook 110 having open top 111 and cradle bottom 112 with a longitudinal axis 113. In operation, grip member 20 is passed through open top 111 for releasable restraint in cradle bottom 112 such that the longitudinal axis of grip member 20 is substantially aligned with longitudinal axis 113 of substantially J-shaped hook 110. In this way grip member 20 of preexisting handle 11 is operably restrained to, in turn, prompt user control of the wheeled object via handle grip 103 of handle conversion apparatus 100. Accordingly, better and more comfortable control can be exerted over the wheeled object—through a hand grip oriented in a position parallel to the direction of propelled movement.

In other embodiments, as shown in FIGS. 5 and 6, apparatus attachment means 101 comprises connecting member 114 and straps 115 and 116, spaced along connecting member 114, to facilitate attachment to the existing control of the wheeled object. It is contemplated that any number of one or more straps of various widths and lengths can be used to attach apparatus 100 to grip member 20 of preexisting handle 11. In one embodiment shown in FIG. 5, straps 115 and 116 are secured about grip member 20 of preexisting handle 11 by snap members 117 and 118, respectively. In another embodiment shown in FIG. 6, straps 115 and 116 are secured about grip member 20 of preexisting handle 11 by hook and loop attachment members 119 and 120, respectively. Of course, other means of attachment are well-known in the carrying case art, such as clip-eyelet, hook-grommet, button-eyelet, and other similar, selectively releasable fastening systems. Additionally, of course, it is within the scope of the present invention for apparatus attachment means 101 to be permanently secured to preexisting handle 11 using rivets, nuts and bolts, adhesive, stitching and other similar fastening techniques.

Hand grip 103 has first end 130, second end 131 and longitudinal axis 132. As shown in FIGS. 1 and 2, in one preferred embodiment of the invention, hand grip 103 is covered by foam padding 135, which, in part, facilitates the user's grip of hand grip 103. In another embodiment (shown in FIG. 4), hand grip 103 is molded with a plurality of finger receiving indentations 232, which, facilitate the user's grip of hand grip 103. While only two embodiments are shown in the drawings, other configurations for hand grip 103 should be deemed to be within the scope of the present invention, as long as the longitudinal axis of those embodiments are substantially perpendicular to grip member 20 of preexisting handle 11.

Orientation means 102 prompts hand grip 103 into an orientation such that longitudinal axis 132 is oriented substantially parallel to the forward and backward motion of the wheeled object. As shown particularly in FIGS. 2, 3 and 4, orientation means 102 are operably attached between the attachment means and the hand grip so as to integrate the entirety of the handle conversion apparatus 100.

In a preferred embodiment shown in FIGS. 1, 2 and 3, orientation means 102 includes first member 140, second member 141 and neck 145 configured in a substantially Y-shaped configuration. In particular in the preferred embodiment, neck 145 operably connects attachment means 101 to first member 140 and to second member 141. First member 140 operably connects to first end 130 of hand grip 103. Second member 141 operably connects to second end 131 of hand grip 103. Other configurations which interrelate these elements—such as first member 140 connecting to neck 145 and second member 141 connecting to a portion of first member 140 to form a loop—are also contemplated to be within the scope of the present invention. Additionally, first member 140, second member 141 and neck 145 can each be of varying lengths to further provide physical extension of hand grip 103 from grip member 20 of preexisting handle 11. For purposes of the present invention, the actual reorientation of hand grip 103 from the position of grip member 20 can be achieved in either the first and second members 140 and 141 or neck 145.

In a preferred embodiment of the present handle conversion apparatus, neck 145 is fixed. In another embodiment shown in FIG. 7 of the drawings, the neck 145' includes lower member **145'*a* and upper member 145'*b*, which are connected by a pin such that the lower and upper neck members 145'*a* and 145'*b* swivel relative to one another so as to fold the apparatus about the neck to facilitate storage of apparatus 100—when not in use. In yet another embodiment shown in FIG. 8, neck 145" includes lower member 145"*a*, upper member 145"*b* and universal joint 146. Universal joint 146 allows the upper and lower neck members 145"*a* and 145"*b* to swivel as shown by the arrow in FIG. 8. As in the previous embodiment, this construction facilitates storage of apparatus 100 by allowing relative rotation of hand grip 103 and apparatus attachment means 101 into the same plane when apparatus 100 is not in use, such that apparatus 100 can lay substantially flat. As further shown in FIG. 7, upper member 145'*b* can also be capable of rotation about the longitudinal axis of the neck, as explained with respect to FIG. 8, thus allowing both longitudinal rotation, as well as transverse folding to provide a more compact manner for storing apparatus 100 in a carry-on bag. Each of these embodiments further provides adjustability in orienting the useable position of hand grip 103 relative to hand grip 20**—at angle other than 90°.

As the primary object of handle conversion apparatus 100 is the provision of hand grip 103 that provides a gripping member that is substantially parallel to the desired direction of forward and rearward motion of a wheeled object, it is of no moment where the reorientation occurs. Further, the benefits of handle conversion apparatus 100 are conferred where the gripping surface is oriented at any angle from 5 to 175 degrees from the vertical plane of the grip member 20 of preexisting handle 11; appreciating that the closer angular displacement of the gripping surface of hand grip 103 is to 90 degrees, the more comfortable handle conversion apparatus 100 should make the job of propelling such a wheeled object.

FIG. 4 shows another embodiment of handle conversion apparatus 200. In particular in this embodiment, apparatus attachment means 101 comprises a substantially J-shaped hook member as previously described in detail with respect to the preferred embodiment of the present invention. This embodiment differs from the preferred embodiment in the configuration of orientation means 102 and hand grip 103. In particular, in this embodiment, orientation means 102 includes only first member 240 and neck 245. As in the orientation means of the preferred embodiment, neck 245 operably connects apparatus attachment means 101 to first member 240 and first member 240 operably connects to first end 230 of hand grip 103. Second end 231 of hand grip 103 is left unconnected to orientation means 102 in this embodiment. In this embodiment, rather than utilizing padding, hand grip 103 includes a plurality of finger receiving indentations 232 operably disposed about the bottom of hand grip 103.

A number of embodiments for the handle conversion apparatus have been shown in the drawings and described hereinabove. As would be known to those skilled in the art, various elements from these various embodiments can be exchanged one for the other to form different embodiments, which would be within the scope of the present invention.

The foregoing description and drawings merely explain and illustrate the invention and the invention is not limited thereto except insofar as the appended claims are so limited, as those skilled in the art who have the disclosure before them will be able to make modifications or variations therein without departing from the scope of the invention.

What is claimed is:

1. A handle conversion system for facilitating forward and rearward motion of a wheeled object, said handle conversion system comprising:

a preexisting handle on said wheeled object, said preexisting handle including a grip member with a longitudinal axis positioned for use in a plane substantially perpendicular to a desired direction of motion, as prompted by the orientation of wheels on said wheeled object;

system attachment means for restrainably attaching said handle conversion system to said preexisting handle, said system attachment means extending longitudinally along at least a substantial portion of said preexisting handle grip member to restrainably stabilize the orientation of said grip member relative to said system attachment means, a hand grip having a first end, a second end opposite said first end and a hand grip longitudinal axis between said first and second ends, said hand grip longitudinal axis being oriented in a position substantially perpendicular to a plane in which said grip member of said preexisting handle is oriented; and said hand grip being operably attached to said system attachment means so as to operably integrate same, such that said hand grip longitudinal axis is oriented substantially perpendicular to a plane in which said system attachment means is oriented and substantially within the same plane described by said direction of forward and backward motion of said wheeled object.

2. The handle conversion system according to claim 1 wherein said system attachment means comprises a substantially J-shaped hook member having an open top and a cradle bottom, said open top allowing operable yet releasable receipt of said preexisting handle and said cradle bottom being aligned with and operably restraining said preexisting handle grip member thereby operably restraining and removably affixing said preexisting handle.

3. The handle conversion system according to claim 2 wherein said system attachment means operably extends from said first end of said hand grip.

4. The handle conversion system according to claim 3 wherein said system attachment means further operably extends from said second end of said hand grip.

5. The handle conversion apparatus according to claim 1 wherein said system attachment means comprises a connecting member and at least one strap, said at least one strap being configured to operably encircle and operably restrain said grip member of said preexisting handle, through strap affixation means.

6. The handle conversion system according to claim 5 wherein said strap affixation means comprises at least one snap member.

7. The handle conversion system according to claim 5 wherein said strap affixation means comprises at least one mated pair of hook and loop fasteners.

8. The handle conversion system according to claim 5 wherein said system attachment means operably extends from said first end of said hand grip.

9. The handle conversion system according to claim 8 wherein said system attachment means operably extends from said second end of said hand grip.

10. The handle conversion system according to claim 1 in which the invention further comprises a padding member operably disposed about said hand grip.

11. The handle conversion system according to claim 1 in which the invention further comprises a plurality of finger receiving indentations operably disposed about at least the bottom of said hand grip.

12. The handle conversion system according to claim 1 in which the invention further comprises a longitudinally swiveling neck operably positioned between said system attachment means and said hand grid.

13. The handle conversion system according to claim 12 wherein said neck further transversely swivels.

14. The handle conversion system according to claim 1 in which the invention further comprises a transversely swiveling neck.

15. A combination comprising:

a wheeled object having a preexisting handle, said preexisting handle having a grip member with a longitudinal axis positioned for use in a plane substantially perpendicular to a desired direction of forward and rearward motion of said wheeled object; and a conversion handle including apparatus attachment means for restrainably attaching said conversion handle to said preexisting handle, said apparatus attachment means extending longitudinally along at least a substantial portion of said preexisting handle grip member to restrainably stabilize the orientation of said grip member relative to said apparatus attachment means, said conversion handle further including a hand grip having a first end, a second end opposite said first end and a hand grid longitudinal axis between said first and second ends, said hand grid longitudinal axis being oriented in a position substantially perpendicular to a plane in which said grip member of said preexisting handle is oriented, said hand grid being operably attached to said apparatus attachment means such that said hand grid longitudinal axis is oriented substantially perpendicular to a plane in which said apparatus attachment means is oriented and substantially within the same plane described by said direction of forward and backward motion of said wheeled object.

16. The combination according to claim 15 wherein said apparatus attachment means comprises a substantially J-shaped hook member having an open top and a cradle bottom, said open top allowing operable yet releasable receipt of said preexisting handle and said cradle bottom being aligned with and operably restraining said preexisting handle grip member thereby operably restraining and removably affixing said preexisting handle.

17. The combination according to claim 16 wherein said apparatus attachment means comprises a connecting member and at least one strap, said at least one strap being configured to operably encircle and operably restrain said grip member of said preexisting handle, through strap affixation means.

18. The handle conversion apparatus according to claim 17 wherein said strap affixation means includes at least one snap member.

19. The handle conversion apparatus according to claim 17 wherein said strap affixation means comprises at least one mated pair of hook and loop fasteners.

* * * * *

UNITED STATES PATENT AND TRADEMARK OFFICE

CERTIFICATE OF CORRECTION

PATENT NO. : 5,722,118

DATED : Mar. 3, 1998

INVENTOR(S) : Hansen et al.

It is certified that error appears in the above-indentified patent and that said Letters Patent is hereby corrected as shown below:

| | |
|---|---|
| Col. 6, Ln. 37 | Delete "apparatus" and insert instead --system-- |
| Col. 6, Ln. 65 | Delete "grid" and insert instead --grip-- |
| Col. 7, Ln. 20 | Delete "grid" and insert instead --grip-- |
| Col. 7, Ln. 21 | Delete "grid" and insert instead --grip-- |
| Col. 7, Ln. 25 | Delete "grid" and insert instead --grip-- |
| Col. 7, Ln. 26 | Delete "grid" and insert instead --grip-- |

Signed and Sealed this

Twenty-third Day of March, 1999

*Attest:*

Q. TODD DICKINSON

*Attesting Officer*

*Acting Commissioner of Patents and Trademarks*